US007562495B1

(12) United States Patent
Fairchild et al.

(10) Patent No.: US 7,562,495 B1
(45) Date of Patent: Jul. 21, 2009

(54) SHOWER RECEPTOR

(75) Inventors: Robert A. Fairchild, Shingle Springs, CA (US); Denis R. Niemeyer, Granite Bay, CA (US)

(73) Assignee: Fairchild Manufacturing Corp., Sacramento, CA (US)

( * ) Notice: Subject to any disclaimer, the term of this patent is extended or adjusted under 35 U.S.C. 154(b) by 322 days.

(21) Appl. No.: 11/442,025

(22) Filed: May 26, 2006

Related U.S. Application Data

(60) Provisional application No. 60/685,220, filed on May 27, 2005.

(51) Int. Cl.
*A47K 3/16* (2006.01)
*A47K 3/00* (2006.01)
*E04B 2/00* (2006.01)

(52) U.S. Cl. ..... 52/35; 52/302.1; 52/367; 52/371; 52/375; 4/613

(58) Field of Classification Search ..... 52/35, 52/302.1, 302.7, 367, 371, 375; 4/613
See application file for complete search history.

(56) References Cited

U.S. PATENT DOCUMENTS 3,606,617 A * 9/1971 Frazier ..... 4/613
3,675,384 A * 7/1972 Knecht ..... 52/250
3,757,358 A * 9/1973 Chisholm et al. ..... 4/610
5,140,789 A * 8/1992 De Gooyer ..... 52/71
5,845,347 A 12/1998 Young ..... 4/613
6,003,169 A * 12/1999 Davis, Jr. ..... 4/613
6,568,140 B2 * 5/2003 Kirby ..... 52/302.1
6,571,406 B2 * 6/2003 Gerloff ..... 4/613
6,643,863 B1 * 11/2003 Gerber ..... 4/613
6,848,229 B2 * 2/2005 Rossi ..... 52/367
7,296,309 B2 * 11/2007 Nehring ..... 4/613
2004/0205890 A1 10/2004 Smale ..... 4/613
2005/0120475 A1 * 6/2005 Englefield et al. ..... 4/613
2006/0026752 A1 * 2/2006 Torres ..... 4/613
2008/0163420 A1 * 7/2008 Dieter et al. ..... 4/613

* cited by examiner

*Primary Examiner*—Brian E. Glessner
*Assistant Examiner*—Jason Holloway
(74) *Attorney, Agent, or Firm*—Philip L. Bateman

(57) ABSTRACT

A shower receptor installation assembly includes a dense foam underlayment, a base with a sloping floor that fits onto the underlayment, a mesh member attached to the threshold of the base with adhesive, a plurality of strike rails, and a plurality of screed blocks, two or more of the screed blocks being attached with removable adhesive to the bottom edge of each strike rail.

9 Claims, 4 Drawing Sheets

SHOWER RECEPTOR

CROSS-REFERENCE TO RELATED APPLICATION

This application claims the benefit of U.S. Provisional Application Ser. No. 60/685,220, filed May 27, 2005.

FIELD OF THE INVENTION

This invention relates to shower receptors. More particularly, this invention relates to shower receptor installation assemblies.

BACKGROUND OF THE INVENTION

Modern bathrooms often contain free-standing showers that are separate from the bathtub. Some showers have a molded plastic base that also serves as the floor. Other showers have a base upon which ceramic tile and grout are laid. The term "tile" is used herein to refer to any material (ceramic tile, stone, marble, synthetic materials, etc.) that are laid onto a bed of grout. A shower base for a tiled floor is commonly known as a shower receptor. A common shower receptor is a pan made of metal or other suitable impervious material that is attached to the floor over the drain. The pan is coated with hot tar for waterproofing and to provide cushioning to the pan to reduce the possibility of cracking when the shower is used. After the tar has dried for several days, the tile and grout are applied. This "hot mopping" process is relatively expensive because of the manpower required. It also creates a delay of several days.

A variety of alternate shower receptors have been disclosed. For example, Young, U.S. Pat. No. 5,845,347, issued Dec. 8, 1998, discloses a plastic shower receptor produced by forming a plastic base, spraying a waterproof membrane over the base, and then placing flexible backer sheets over the waterproof membrane. Davis, Jr., U.S. Pat. No. 6,003,169, issued Dec. 21, 1999, discloses a shower receptor produced by forming a wooden base, applying sloped wooden stringers and/or polystyrene foam, and then placing an acrylic top layer over the sloped surface. Gerloff, U.S. Pat. No. 6,571,406, issued Jun. 3, 2003, discloses a shower receptor produced by forming a plastic base having gutters and channels in its upper surface. The base also has knobs that mate with indentations in the bottom surface of a floor tile that is placed onto the base. Smale, U.S. Pat. Appln. No. US2004/0205890, published Oct. 21, 2004, discloses a shower receptor made of polyurethane structural foam with an upper surface that is sloped toward a centrally located drain.

These shower receptors suffer from several disadvantages. First, the upper surfaces of their floors provide limited adhesion to the grout. Second, the bed of grout applied to their floors (and the resulting tile surfaces) may not have the desired slope to the drain. Accordingly, there is a demand for a shower receptor that provides excellent adhesion to the grout and that enables the tile to be set with exactly the same slope as the floor of the shower receptor.

SUMMARY OF THE INVENTION

The general object of this invention is to provide an improved shower receptor installation assembly. A more particular object is to provide a shower receptor that provides excellent adhesion to the grout and that enables the tile to be set with exactly the same slope as the floor of the shower receptor.

We have invented an improved shower receptor installation assembly. The shower receptor installation assembly comprises (a) a resilient dense foam underlayment having a perimeter, a drain opening, and an upwardly extending shoulder along part of its perimeter forming an entrance to the shower; (b) a rigid plastic base conformed to fit onto the underlayment, the base having a perimeter, a drain opening, an upwardly extending shoulder along part of its perimeter forming a threshold to the shower, a floor that slopes toward the drain opening, and side walls along all the perimeter except for the threshold; (c) a plastic mesh member attached to the threshold of the base with adhesive, the mesh member being adapted to adhere to grout. The assembly preferably also comprises: (d) a plurality of strike rails having a length, two sides, two ends, and a top edge and a bottom edge, the distance between the top edge and bottom edge defining the height of a strike rail; and (e) a plurality of screed blocks having a top and a bottom, the distance between the top and bottom defining the height of a screed block, two or more of the screed blocks being attached at their top with removable adhesive to the bottom edge of each strike rail. The strike rails and screed blocks are adapted for use in applying a bed of grout to the floor of the base that has the same slope as the floor and that has a depth equal to the height of a strike rail plus the height of a screed block.

We have also invented an improved method of applying a bed of grout on a shower receptor base having a drain opening and a floor that slopes toward the drain opening. The method comprises: (a) obtaining a shower receptor base having a drain and a floor that slopes toward the drain opening; (b) obtaining a plurality of strike rails having a length, two sides, two ends, and a top edge and a bottom edge, the distance between the top edge and the bottom edge defining the height of a strike rail; (c) obtaining a plurality of screed blocks having a top surface and a bottom surface, the distance between the top surface and the bottom surface defining the height of a screed block; (d) attaching with removable adhesive a plurality of screed blocks at their top surfaces to the bottom edge of each strike rail; (e) arranging the strike rails with attached screed blocks on the floor of the base radially about the drain opening, the strike rails with attached screed blocks being oriented so that the screed blocks are against the floor and the top edge of the strike rails are parallel to the floor; (f) adding grout to the floor to a level approximately that of the top edge of the strike rails; (g) troweling the grout to conform to the level of the top edges of the strike rails; (h) separating the strike rails from the screed blocks; (i) removing the strike rails from the grout to create voids while allowing the screed blocks to remain in the grout; and (j) filling in the voids to create a smooth surface for the grout, such that the bed of grout has the same slope as the floor of the base and has a depth equal to the height of a strike rail plus the height of a screed block.

The shower receptor assembly of this invention provides excellent adhesion for the grout and that enables the tile to be set with exactly the same slope as the floor of the shower receptor.

DETAILED DESCRIPTION OF THE INVENTION

Figure 1:
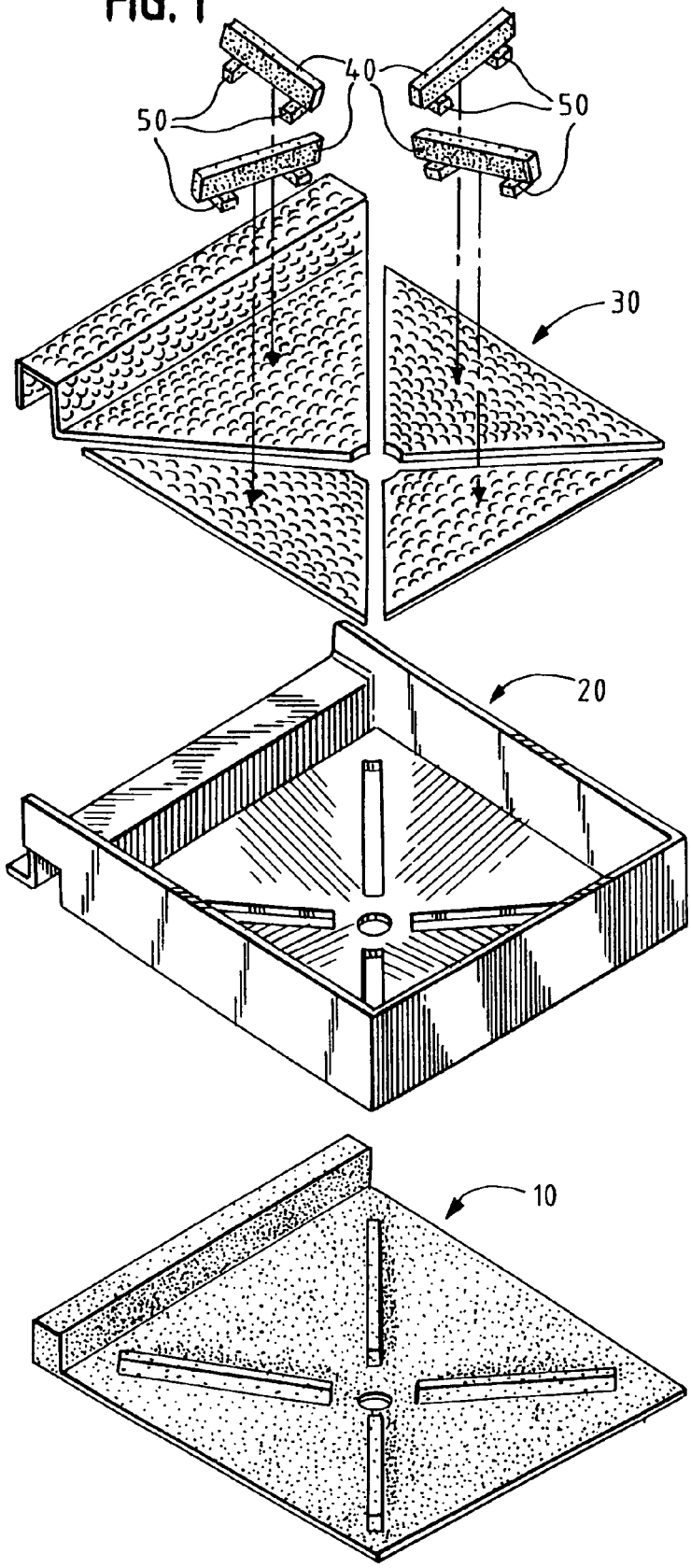
FIG. 1 is an exploded top perspective view of a preferred embodiment of the shower receptor of this invention.
Figure 2:
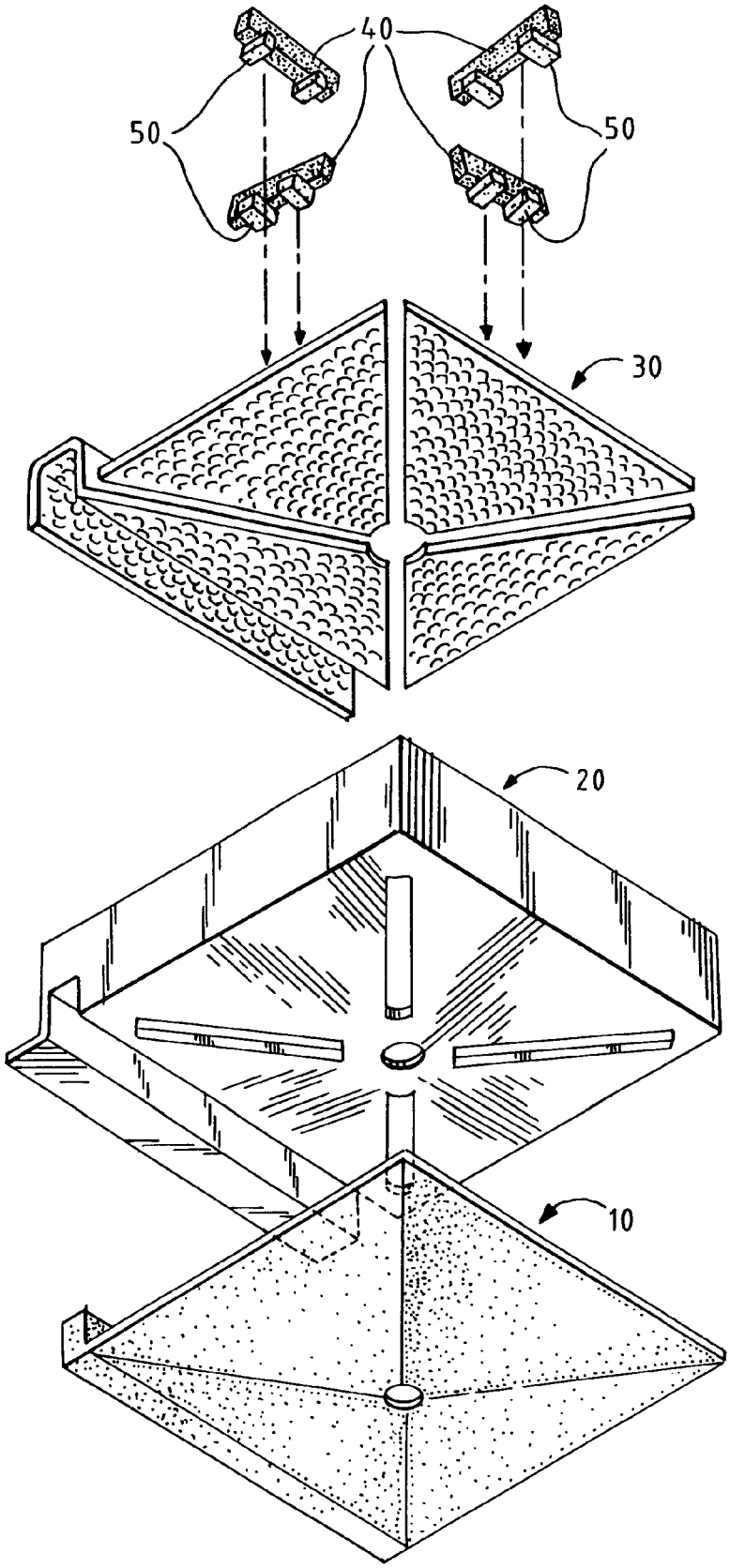
FIG. 2 is an exploded bottom perspective view thereof.

This invention is best understood by reference to the drawings. Referring to FIGS. 1 and 2, the preferred embodiment of the shower receptor installation assembly comprises five components. They are an underlayment 10, a base 20, a plurality of mesh members 30, a plurality of strike rails 40, and a plurality of screed blocks 50. Each of the components is discussed in detail below.

The underlayment 10 is a resilient foam monolith. It has a drain opening that fits directly over the drain in the subfloor. The underlayment has an upwardly extending shoulder along part of its perimeter. The portion of the perimeter with the shoulder forms the threshold (entrance) to the shower. The underlayment preferably contains four or more detents (raised ribs), the purpose of which is described below. The underlayment is generally rectangular in shape, preferably square, and the shoulder runs along one of the four sides. The drain opening is generally centrally located. The underlayment serves two primary functions. First, it is sufficiently resilient to conform to minor imperfections in the subfloor upon which it is laid. Second, it supports the base.

The second component of the shower receptor installation assembly is a base 20. The base is supported by, and conformed to fit onto, the underlayment. The base has a floor that slopes toward an opening that is located directly over the drain opening in the underlayment and the drain in the subfloor. The base has side walls along all the perimeter except for the threshold (the portion fitting over the shoulder of the underlayment). The base preferably contains four or more hollow detents (indents when viewed from underneath) that fit over the detents in the underlayment. The primary purpose of the detents is to provide structural strength to the base. The detents also help to align the mesh members. The base is rigid and is preferably made of a thermally molded acrylonitrile-butadiene-styrene (ABS) plastic having a thickness of about one-fourth inch. The base is preferably made of a single piece so that it provides complete waterproofing for the shower.

The third component is one or more mesh members 30. One mesh member is attached to the threshold of the base with a suitable adhesive. In the preferred embodiment, additional mesh members are also attached to the floor of the base. If attached to a floor containing detents, the mesh members preferably fit between the detents. Mesh members are also optionally attached to the inside surfaces of the side walls of the base. The mesh members are open-cell three-dimensional nylon entangled filaments. They have a thickness of about one-eighth to one inch, preferably about one-fourth to one-half inch. The mesh members are available commercially from several sources. A preferred mesh member is the WATERWAY drainage mat manufactured by Stuc-O-Flex International, Inc. of Redmond, Wash. The use of the product for stucco exterior finish is described in the company's website at www.stucoflex.com. The primary functions of the mesh members are to provide adherence and reinforcement to the grout. The mesh members also serve a secondary function. After the grout and tile are applied, voids remain in the mesh members. If a crack develops in the grout, the water will flow down into the mesh members and to the drain. The mesh members attached to the floor are preferably triangular in shape. It is preferable for the mesh members to fit in the areas in between the detents. Accordingly, the number of floor mesh members preferably corresponds with the number of spaces between the detents in the base.

An optional fourth component of the shower receptor installation assembly is a plurality of strike rails 40. Each strike rail has a length, two sides, two ends, a top edge and a bottom edge. The dimensions of the strike rails are a matter of choice that depends on the thickness of the grout that will be applied. In general, the strike rails are about six to thirty inches in length (the distance from end to end), about one-half to two inches in width (the distance from side to side), and about one to four inches in height (the distance from the top edge to the bottom edge). The strike rails are preferably made of an inexpensive rigid material. Suitable materials include plastics such as polyethylene, polypropylene, polystyrene, and the like. As will be discussed below, the strike rails are used during application of the grout and are then removed and discarded. The number of strike rail can vary from three to sixteen or more. The number is preferably four to ten and most preferably six to eight. However, only four strike rails are shown in FIGS. 1 and 2 for clarity.

An optional fifth component of the shower receptor installation assembly is a plurality of screed blocks 50. Each screed block has a length, two sides, two ends, a top surface and a bottom surface. The screed blocks are preferably about two to six inches in length (the distance from end to end), about two to four inches in width (the distance from side to side), and about one to four inches in height (the distance from the top surface to the bottom surface). The screed blocks are preferably made of an inexpensive rigid material similar or identical to the material used for the strike rails. As will be discussed, the screed blocks are completely covered by grout and serve no function after the grout is applied. The number of screed blocks depends on the number of strike rails. There are at least two screed blocks for each strike rail and may be four or more screed blocks for each strike rail. The top surfaces of the screed blocks are attached with removable adhesive to the bottom edge of each strike rail. The adhesive is strong enough that the screed blocks remain attached to the strike rails as they are moved about, but weak enough so that the strike rails can be separated after the grout is applied. A preferred adhesive is SCOTCH GRIP 5M adhesive, a commercial product of 3 M of St. Paul, Minn.

The installation of the shower receptor assembly can now be considered. It is assumed that a suitable location for the shower has been constructed. The suitable location includes a subfloor with a floor drain and roughed-in (exposed studs) side and back walls. The first step is to place the underlayment-base-mesh members assembly in the desired location with the shoulder in the opening to form the threshold. The wall covering can then be mounted on all or an upper portion of the side walls.

The strike rails with the attached screed blocks are placed onto the floor in a radial pattern around the drain, as seen in FIGS. 1 and 2. The rails and blocks can be placed onto the mesh sections or can be placed on the detents or a combination of both. If the rails and blocks will be placed only on the detents, the screed blocks preferably contain a notched lower surface so they straddle the detents and sit securely. The strike rails with attached screed blocks are oriented so that the screed blocks are against the floor and the top edge of the strike rails are perpendicular to the floor (pointed up). The shower receptor is then ready for grout. FIGS. 3 to 6 are perspective views of four steps in the grout installation process. FIGS. 7 to 11 are side elevation views of the same four steps in the grout installation process.

Figure 3:
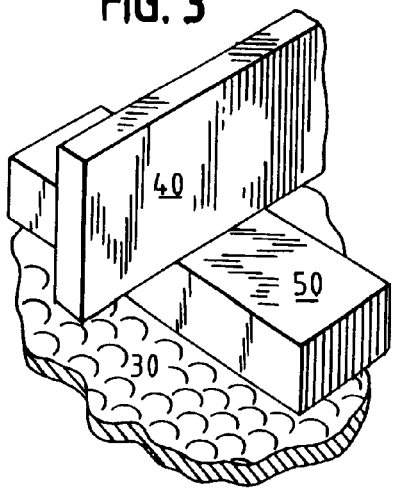
FIG. 3 is a top perspective view of a first step in practicing the grout application method of this invention.
Figure 4:
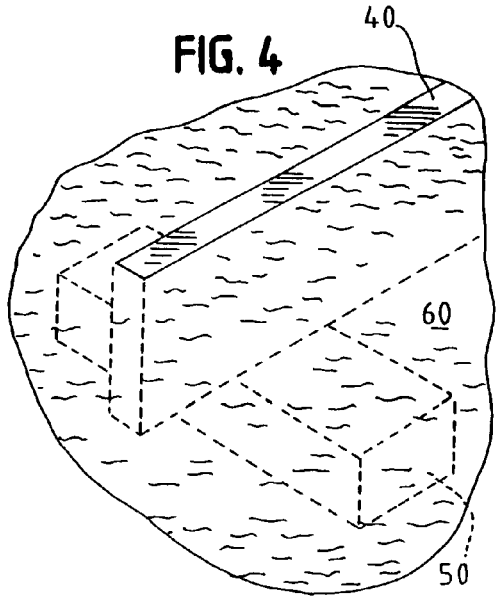
FIG. 4 is a perspective view of a second step thereof.
Figure 7:
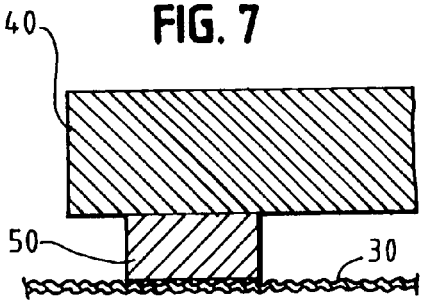
FIG. 7 is a sectional side elevation view of the first step in practicing the grout application method of this invention.
Figure 8:
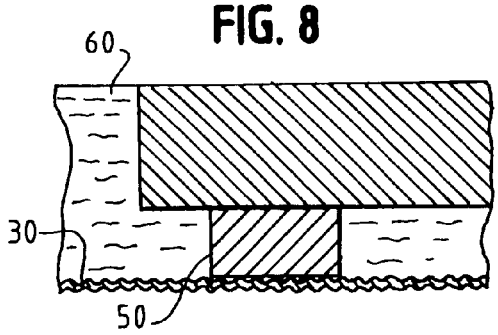
FIG. 8 is a sectional view of the second step thereof.

FIGS. 3 and 7 show a strike rail 40 and a screed block 50 resting on a mesh member 30 on the sloped floor of the shower receptor. As shown in FIGS. 4 and 8, the grout 60 is then added to the shower receptor to the level of the top edge of the strike rails. The grout adheres strongly to the mesh members to create exceptional stability. The grout is then troweled smooth using the tops of the strike rails as a guide. The result is a bed of grout that is sloped exactly the same as the slope of the floor of the base. Stated in another way, the bed of grout is parallel to the floor of the base at every location.

Figure 5:
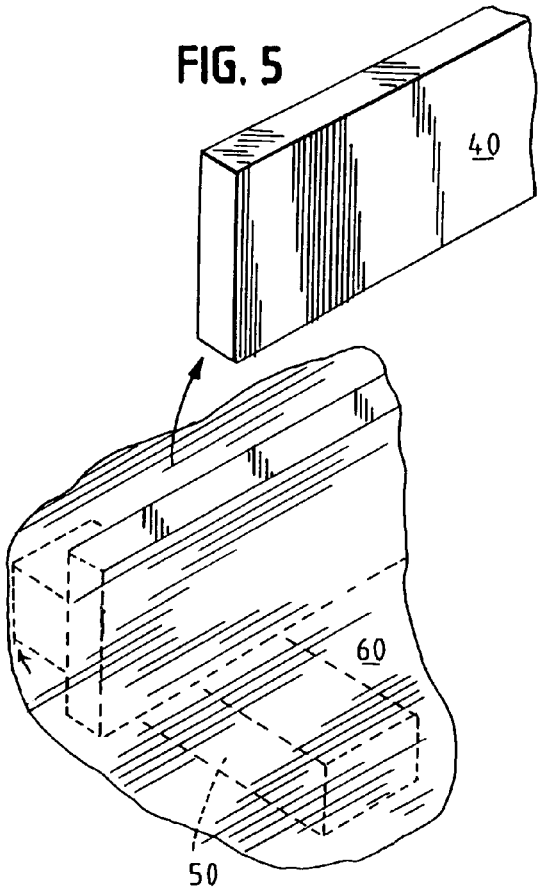
FIG. 5 is a perspective view of a third step thereof.
Figure 6:
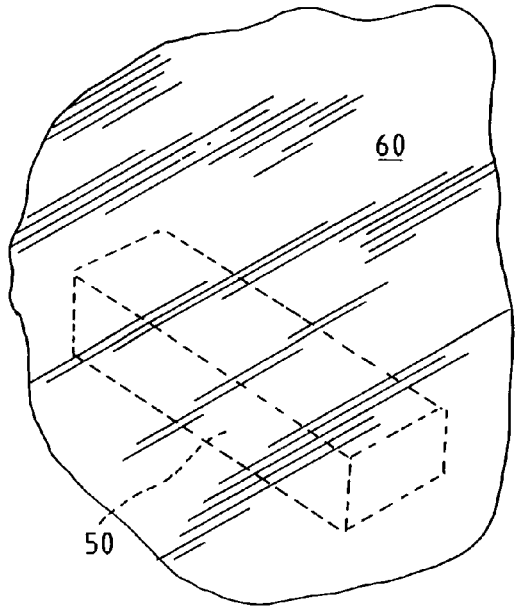
FIG. 6 is a perspective view of a fourth step thereof.
Figure 9:
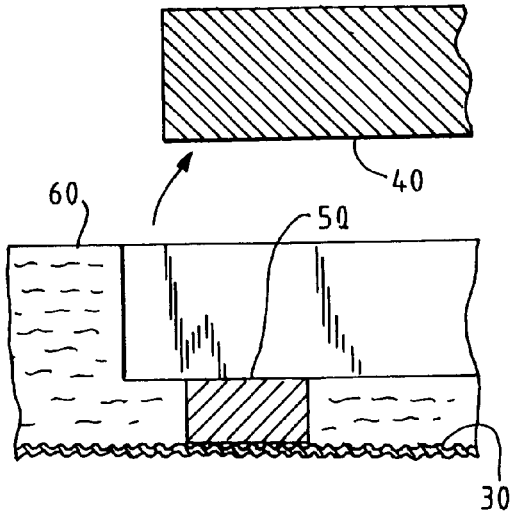
FIG. 9 is a sectional view of the third step thereof.
Figure 10:
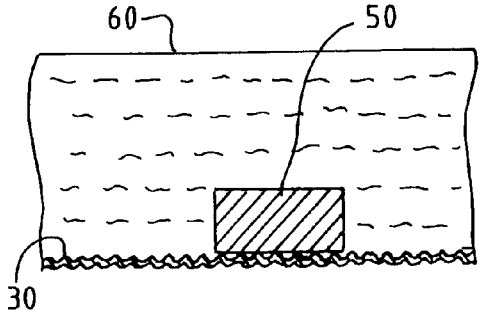
FIG. 10 is a sectional view of the fourth step thereof.

As shown in FIGS. 5 and 9, the next step is to remove the strike rails. The strike rails separate easily from the screed blocks because of the removable adhesive. The screed blocks are left in place. Voids are left in the grout where the strike rails had been. As shown in FIGS. 6 and 10, the final step is to fill in the voids. The perfectly-sloped bed of grout is then ready for tiling. It can be appreciated that the depth of the grout bed is equal to the height of the screed blocks plus the height of the strike rail.

We claim:

1. A shower receptor installation assembly for a subfloor with a drain, the assembly comprising:

(a) a resilient dense foam underlayment having a perimeter, a drain opening, and an upwardly extending shoulder along part of its perimeter forming an entrance to the shower;

(b) a rigid plastic base conformed to fit onto the underlayment, the base having a perimeter, a drain opening, an upwardly extending shoulder along part of its perimeter forming an entrance to the shower, a floor with an upper surface that slopes toward the drain opening, and side walls along all the perimeter except for the part containing the upwardly extending shoulder;

(c) a mesh member attached to the upper surface of the floor of the base with adhesive, the mesh member being adapted to adhere to grout;

(d) a plurality of screed blocks resting upon the mesh member, each screed block having a top surface and a bottom surface, the distance between the top surface and the bottom surface defining the height of a screed block; and (e) a plurality of strike rails, each strike rail having two sides, a top edge, and a bottom edge, the distance between the top edge and bottom edge defining the height of a strike rail; each strike rail being attached at its bottom surface to the top surface of two or more screed blocks with removable adhesive;

the strike rails and screed blocks being adapted for use in applying a bed of grout to the floor of the base that has the same slope as the floor and that has a depth equal to the height of a strike rail plus the height of a screed block.

2. The shower receptor of claim 1 wherein the base contains a plurality of detents and wherein a plurality of mesh members fit between the detents.

3. The shower receptor of claim 2 wherein the underlayment and base are rectangular in shape.

4. The shower receptor of claim 3 wherein the mesh members have a thickness of about one-eighth to one inch.

5. The shower receptor of claim 4 wherein the number of strike rails is four to ten.

6. The shower receptor of claim 5 wherein the number of screed blocks is two for each strike rail.

7. The shower receptor of claim 6 wherein each strike rail has a length of about six to thirty inches, a width of about one-half to two inches, and a height of about one to four inches.

8. The shower receptor of claim 7 wherein each screed block has a length of about two to six inches, a width of about two to four inches, and a height of about one to four inches.

9. The shower receptor of claim 8 wherein the mesh members are triangular in shape.

* * * * *